United States Patent [19]

Kawakami et al.

[11] 3,941,946

[45] Mar. 2, 1976

[54] ELECTROSTATIC TRANSDUCER ASSEMBLY

[75] Inventors: Hirotake Kawakami; Atsushi Matsuda, both of Tokyo; Kazumasa Takahashi, Chofu, all of Japan

[73] Assignee: Sony Corporation, Tokyo, Japan

[22] Filed: June 6, 1973

[21] Appl. No.: 367,579

[30] Foreign Application Priority Data

June 17, 1972 Japan ..... 47-71773[U]

[52] U.S. Cl. ..... 179/111 R; 179/179

[51] Int. Cl.[2] ..... H04R 19/00; H04R 19/02

[58] Field of Search ..... 179/111 R, 111 E, 106, 179/1 E, 116, 178, 179

[56] References Cited

UNITED STATES PATENTS 3,118,022 1/1964 Sessler et al. ..... 179/111 E 3,136,867 6/1964 Brittell ..... 179/111 R 3,778,562 12/1973 Wright ..... 179/111 R

*Primary Examiner*—Kathleen H. Claffy

*Assistant Examiner*—George G. Stellar

*Attorney, Agent, or Firm*—Hill, Gross, Simpson, Van Santen, Steadman, Chiara & Simpson

[57] ABSTRACT

An electrostatic transducer assembly including a pair of transducer units, each unit having a pair of plates with a conductive coating and a diaphragm disposed between the plates. Both diaphragms are biased by a single source and the electrode plates are energized in such a way as to move the diaphragms in a common direction.

3 Claims, 5 Drawing Figures

ELECTROSTATIC TRANSDUCER ASSEMBLY

BACKGROUND OF THE INVENTION

1. Field of the Invention

The field of art to which this invention pertains is electrostatic speakers and in particular to means for biasing the speakers to use only a single voltage source and also to constructional means for supporting and mounting the individual transducer units of the speaker.

2. Description of the Prior Art

In general, electrostatic transducers have been limited with respect to power output capability, particularly in the lower range of frequency response, because of narrow spacing between the active elements thereof. With the given spacing, only a given voltage may be applied due to breakdown of the air dielectric, and thus a limit to the force which can be developed is established.

Application of this class of transducer has therefore been limited to designs that can accept this limitation. In particular, this limitation is more noticeable at low audio frequencies, since it is desirable to totally enclose the back of the speaker with a reasonably sized enclosure, and this in turn implies that high forces be developed to move the diaphragm against the air loading.

The foregoing will be more apparent in considering a system, by way of example, for converting audio frequency electrical energy into acoustical energy. It is axiomatic in the art that equal power output over the audio frequency range a much greater mass of air must be moved at the lower frequencies and it is the reason that low frequency loudspeakers are much larger and more heavily constructed than high frequency loudspeakers. In any case, the low power output limitation is the result of the limited maximum excursions demanded of the flexible diaphragm.

In order to solve the above problems, Brettel has developed a new electrostatic transducer as described in his U.S. Pat. No. 3,136,867 (issued June 9, 1964).

According to Brettel's transducer, it is required to provide two kinds of D.C. voltage sources in order to drive both diaphragms in the same direction. Generally, since it is required high voltage for bias, it is not wished to provide two kinds of sources.

SUMMARY OF THE INVENTION

It is an important feature of the present invention to provide an improved electrostatic transducer speaker assembly.

It is another feature of the present invention to provide an electrostatic speaker which utilizes only a single bias source.

It is an object of the present invention to provide a novel means for mounting transducer units of an electrostatic speaker assembly.

It is also an object of the present invention to provide an electrostatic speaker assembly which includes a pair of planar transducer units and a housing for mounting the same, the housing having locating means cooperable with the transducer units for positioning the units relative to the housing and relative to each other.

It is another object of this invention to provide an electrostatic speaker assembly as described above wherein the housing has a sloped rear wall portion to prevent the formation of undesirable resonances.

These and other objects, features and advantages of the invention will be apparent from the following description and the associated drawings wherein reference numerals are used to designate a preferred embodiment.

DESCRIPTION OF THE PREFERRED EMBODIMENT

This invention relates to an electrostatic speaker which has a pair of transducer units biased by a single voltage source. Also, the invention relates to structural mounting means for the elements of the speaker assembly.

Figure 1:
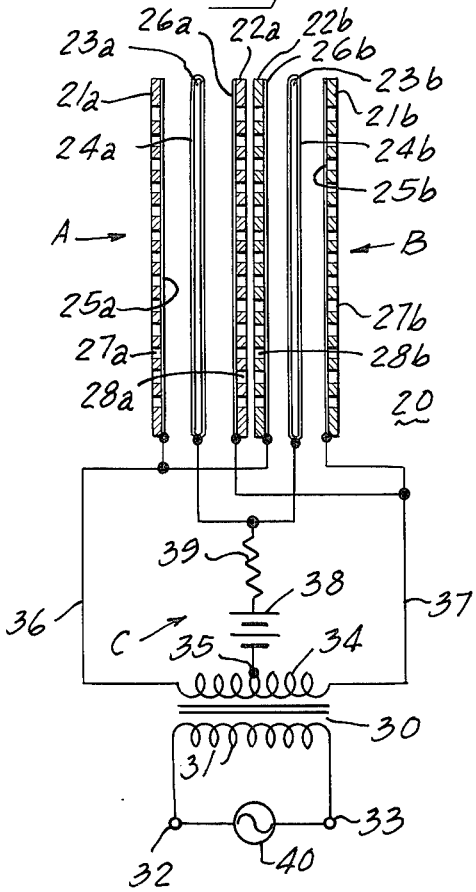
FIG. 1 is an illustration of the positioning of the elements of the transducer units of the present invention and includes a schematic showing the single bias source and the application of the audio signal in the transducer circuit.

As shown in FIG. 1, an electrostatic transducer assembly 20 comprises a pair of laminated transducer units A and B and an electric drive circuit C. The unit A includes a pair of plates 21*a* and 22*a* and a flexible diaphragm 23*a* such as Mylar with a conductive coating 24*a* of silver or the like. Plates 21*a* and 22*a* are made from plastic material, such as epoxy resin, acrylic acid resin, or so on, and have conductive layers 25*a* and 26*a* at the inside surface thereon, each having a plurality of apertures 27*a* and 28, respectively. The other unit B is the same, therefore, each corresponding element is numbered with the letter *b*.

The electric circuit C comprises a transformer 30 having a primary winding 31 connected between two terminals 32 and 33 and a secondary winding 34 having a center tap 35. One lead 36 of the secondary winding 34 is connected to the conductive layers 25*a* of the plate 21*a* of the unit A and also to the conductive layer 26*b* of the plate 22*b* of the unit B. The other lead 37 of the secondary winding 34 is connected to the conductive layer 25*b* of the plate 21*b* of the unit B and also to the conductive layer 26*a* of the plate 22*a* of the unit A. A DC bias source 38 is connected to the center tap 35, and the other side thereof is connected to both conductive layers of the diaphragm 23*a* and 23*b* of the units A and B through a resistor 39. Further, a signal source 40 is connected between two terminals 32 and 33 of the primary winding 31. When an alternating signal is supplied from the signal source 40, the conductive layer 25 *a* of the plate 21*a* of the unit A and the conductive layer 26*b* of the plate 22*b* of the unit B are given the same potentials with each other, and the conductive layer 26*a* of the plate 22*a* of unit A and the conductive layer 25*b* of the plate 21*b* of the unit B are given the same potentials with each other, but opposite potentials with respect to the conductive layers 25*a* and 26*b*. In other words, the conductive layer 25*a* of the plate 21*a* and the conductive layer 26*a* of the plate 22*a* of unit A are given opposite potentials, and also the conductive layer 26*b* of the plate 22*b* and the conductive layer 25*b* of the plate 21*b* are given opposite potentials, respectively. Further, since the layers 24*a* and 24*b* of the diaphragms 23*a* and 23*b* are given positive potentials by the D.C. bias source 38, both diaphragms 23*a* and 23*b* are driven in the same direction.

Now, if a single diaphragm is placed between a pair of plates, the sound pressure $P_1$ is given by:

$$P_1 = -\frac{jw\rho_o a^2}{2r} \cdot \frac{Co^2}{\epsilon_o S} \cdot \frac{Eoei}{jwM_D + jw2M_A + 2R_A}$$

where:

$\rho_o$ = density of air
$a$ = semidiameter of the diaphragm
$r$ = distance between the plate and measure point
$C_o$ = capacitance
$\epsilon_o$ = dielectric constant of air
$S$ = area of the plate
$M_D$ = mass of the diaphragm
$M_A$ = mass component of radiation impedance
$R_A$ = resistance component of radiation impedance
$\epsilon_0$ = bias voltage
$ei$ = signal voltage However, if a pair of the units, each having a diaphragm, is placed in parallel, as in this invention, since both diaphragms are moved in the same direction, the sound pressure $P_2$ is given by:

$$P_2 = -\frac{jw\rho_o a^2}{2r} \cdot \frac{Co^2}{\epsilon_o S} \cdot \frac{Eoei}{jwM_D + jw2M_A + 2R_A + Z_{AM}}$$

wherein, $Z_{AM}$ is a mutual radiation impedance caused by the operation of both diaphragms, and $$Z_{AM} = R_{AM} + X_{AM}$$

$R_{AM}$ = resistance component
$X_{AM}$ = reactance component also, $$R_{AM} = -R_A,\ X_{AM} = -jwM_A$$

$$\therefore Z_{AM} = -(R_A + jwM_A)$$

Therefore, the sound pressure $P_2$ is rewritten by $$P_2 = -\frac{jw\rho_o a^2}{2r} \cdot \frac{Co^2}{\epsilon_o S} \cdot \frac{Eoei}{jwM_D + jwM_A + R_A}$$

Generally, $$jwM_D + jwM_A >> R_A$$

and $$M_A >> M_D$$

so that $$(|P_2|/|P_1|) \approx (jw2M_A/jwM_A) = 2$$

Therefore, it will be understood that the sound pressure regarding this invention increases by 6 dB in a region between $fo$ and $ka < 1.4$.

Figure 3:
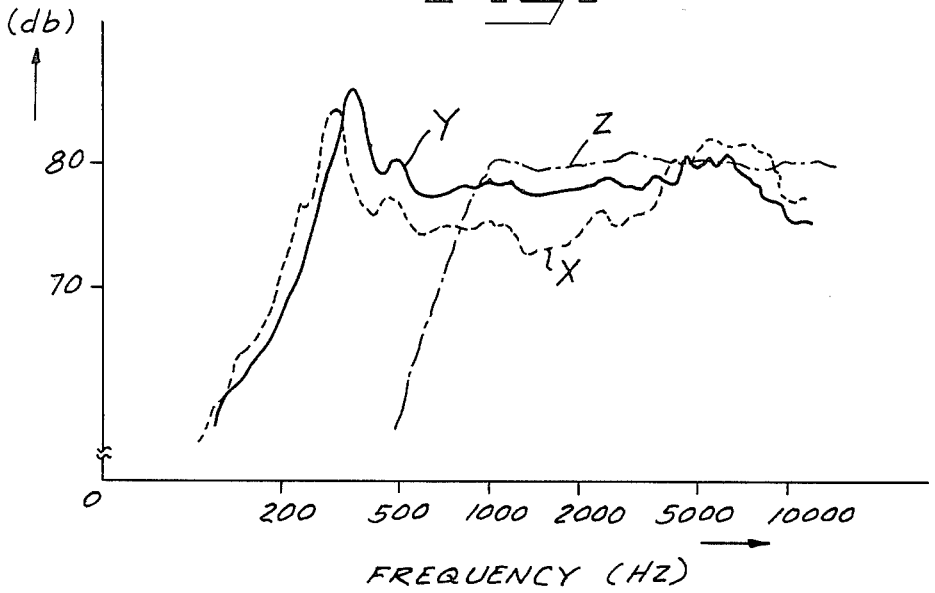
FIG. 3 shows a db vs. frequency diagram of the speaker of the present invention.

A mathematical explanation as described above is supported by our actual examination as shown in FIG. 3.

FIG. 3 is a graph showing the pressure response frequency characteristic of certain electrostatic transducers. The curve X indicates a frequency characteristic of a single diaphragm as prior art, and the curve Y indicates a frequency characteristic of this invention. It is noted that, according to this invention, the response is increased by about 6 dB in the mid range of the frequency, (400 Hz to 4 KHz).

Figure 5:
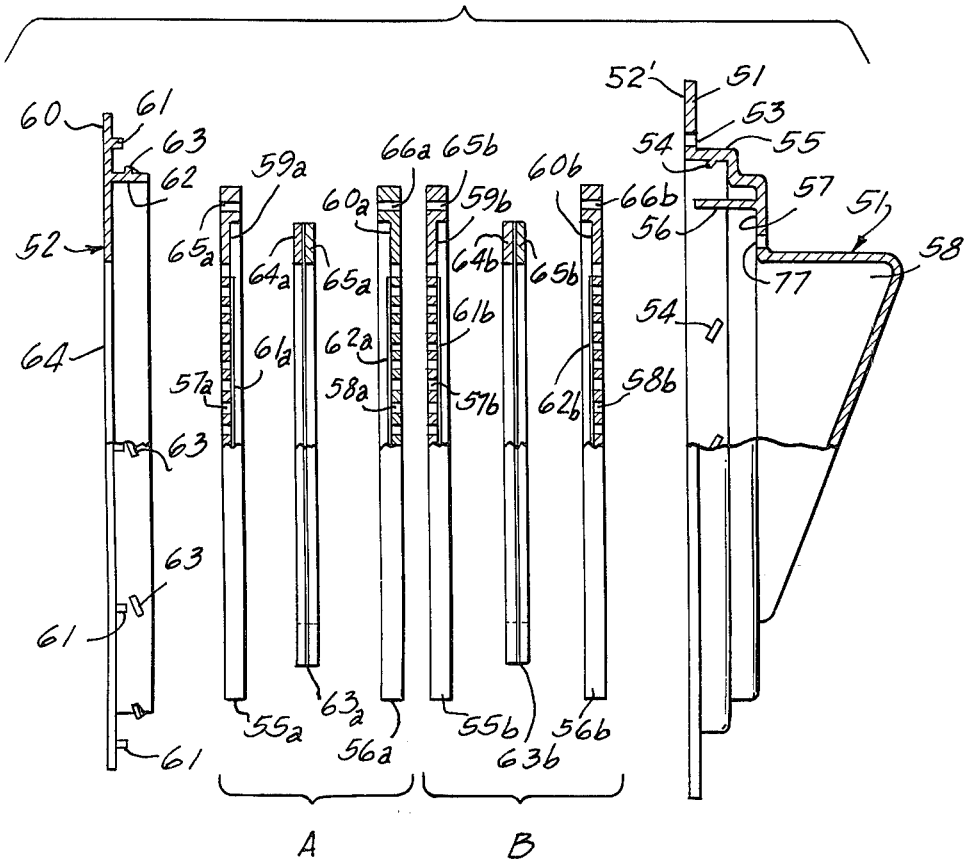
FIG. 5 is an exploded view of the speaker elements and the associated housing.

FIG. 5 is a view of an electrostatic loudspeaker having a pair of electrostatic transducer units as described above. The loudspeaker includes an enclosure 51, a pair of electrostatic transducer units A and B, and a cover 52. A pair of back-electrode plates 55*a* and 56*a* of the unit A made from plastic material, such as epoxy resin, has a plurality of apertures 57*a* and 58*a* and hollows 59*a* and 60*a*, respectively, and conductive layers 61*a* and 62*a* are coated on the surface of both plates. A diaphragm 63*a* is supported by a pair of conductive rings 64*a* and 65*a*. Further, the diaphragm 63*a* is adhered to the rings 64a and 65*a* with conductive adhesive material. The other unit B is constructed in the same manner, so that each element of unit B is numbered with a letter *b*. The enclosure 51 has a flange 52' having a plurality of apertures 53, a plurality of slanted projections 54 on a cylindrical part 55, a plurality of posts 56 formed on a flat portion 57 to place the pair of units A and B thereon, and a back-chamber 58. It is noted that the back-chamber 58 does not have surfaces which oppose each other. In this case, it is a triangle shape in sectional view. Therefore, the enclosure 51 has a wall portion whose trangent is sloped at an angle substantially greater than zero and substantially less than 90° with respect to the plane of the units A and B. In other words, the enclosure 51 has a planar rear wall sloped from a first point located substantially adjacent to the plane of the units A and B to a second point spaced substantially rearwardly of said plane.

The cover 52 has a flange member 60 with a plurality of projections 61 to be engaged by the apertures 53 of the enclosure 51, and a cylindrical member 62 having a plurality of slanted projections 63 to be engaged with the projections 54 of the enclosure 51. An opening 64 is formed in the cover 52 to radiate sound. Further, both projections 54 and 63 are formed as a part of screws, and each of plates 55*a*, 56*a*, 55*b* and 56*b* have apertures 65*a*, 66*a*, 65*b* and 66*b*, respectively, to permit the insertion of posts 56.

Figure 2:
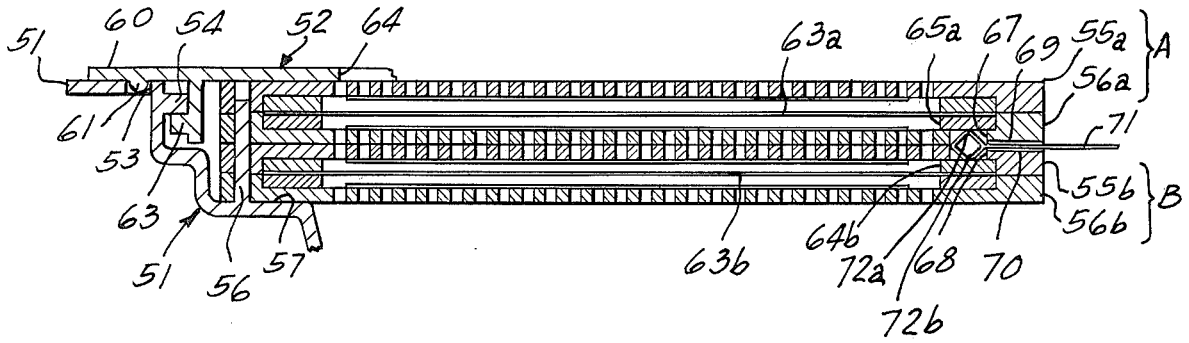
FIG. 2 is a cross section of the pair of transducer units comprising the speaker assembly of the present invention.

Furthermore, as shown in FIG. 2, the plates 56*a* and 55*b* of the units A and B have apertures 67 and 68 and slits 69 and 70 to permit an insertion of a conductive terminal 71. The terminal 71 is made from a leaf spring and has a pair of circular portions 72*a* and 72*b* which connect to the rings 65*a* and 64*b* of the diaphragms 63*a* and 63*b*, respectively, so that a bias voltage is supplied to them through only one terminal 71.

Figure 4:
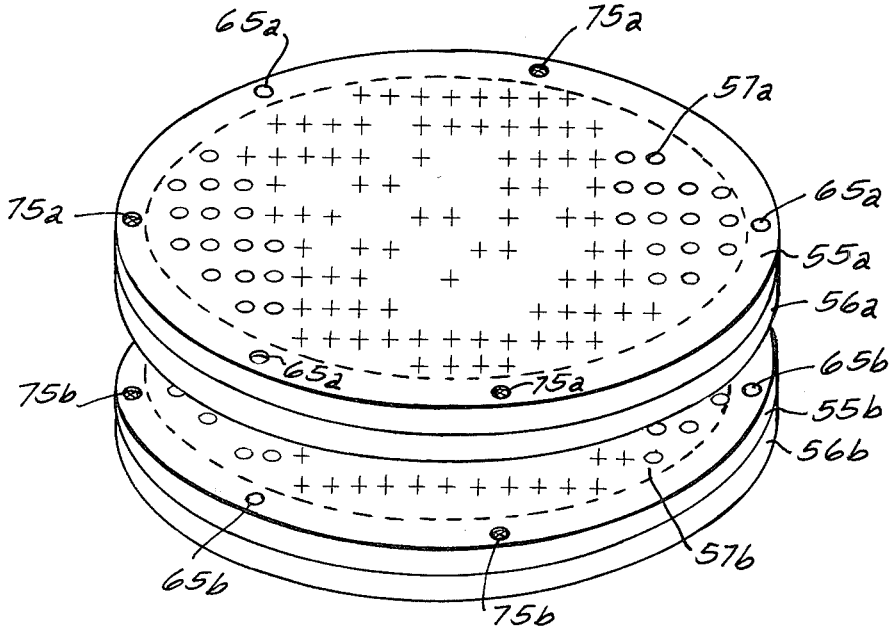
FIG. 4 shows the arrangement of the speaker plates and the use of the locating means of the present invention.

In the course of assembling the units, the plates 55*a* and 56*a* are joined to the diaphragm 63*a* and to each other by a plurality of screws 75*a* as shown in FIG. 4. Also, the plates 55*b* and 56*b* are joined through the diaphragm 63*b* to each other by a plurality of screws 75*b*.

As shown in FIG. 2, the units A and B are inserted into the enclosure 51 so as to meet the apertures 65*a*, 66*a*, 65*b* and 66*b* with the posts 56, together with the terminal 71. In this case, the free end of the terminal 71 is fed out from the enclosure 51, for example, through an aperture 77, as shown in FIG. 5, and the other leads (not shown) for the conductive layers may be fed out in the same manner.

Then, the cover 52 is screwed into the cylindrical portion 55, so that both projections 54 and 63 are engaged with each other, and the projections 61 of the cover 52 are inserted into the apertures 53 of the flange 52' so that the cover 52 is fixed to the enclosure 51. Since the units A and B are depressed by the flange 60 of the cover 52, they are mounted on the flat portion 57, of the enclosure 51, rigidly.

Further, an absorbent material may be enclosed in the chamber 58. Since the chamber 58 of the enclosure 51 does not provide faces which oppose to each other, standing waves are not developed. As shown on curve Z in FIG. 3, a relatively flat frequency characteristic is established by the enclosure 51. Also, the response is increased about 3dB.

It will be well understood by those skilled in the art that many modifications and variations may be made without departing from the spirit and scope of the novel concepts of this invention.

We claim as our invention:

1. An electrostatic transducer assembly comprising:

first and second transducer units, each having a pair of apertured plates with conductive coatings and a conductive diaphragm fixedly disposed between the plates at the periphery thereof, a housing having a recessed region for receiving the two transducer units, locating pins positioned within the recessed region of the housing and extending outwardly therefrom, each of the transducer units having locating openings for positioning the unit over the pins in the housing, means for extending electrical leads from the respective apertured plates and diaphragm through the housing, and means for locking the two transducer units in place over the pins.

2. An electrostatic transducer assembly comprising a first transducer unit consisting of a pair of apertured plates each having a conductive layer and a conductive diaphragm disposed between said plates, a second transducer unit consisting of a pair of apertured plates each having a conductive layer and a conductive diaphragm disposed between said plates, the first and second transducer units being sandwiched together to form an assembly whereby each unit has an outside and an inside plate of the assembly, a single polarity bias source coupled to both said diaphragms, a source of audio signal having a first and second polarity, the outside plate of the first unit and the inside plate of the second unit being supplied with the first polarity of the audio signal, and the inside plate of the first unit and outside plate of the second unit being supplied with the second polarity of the audio signal source.

3. A transducer assembly in accordance with claim 2, wherein the source of audio signal comprises an audio transformer including a transformer secondary, one end of the secondary being the first polarity and the other end being the second polarity and the bias source being coupled from the center tap of the secondary to both diaphragms.

* * * * *